US012715639B2

(12) United States Patent
Testoni et al.

(10) Patent No.: US 12,715,639 B2
(45) Date of Patent: Aug. 25, 2026

(54) OPERATING STATION FOR A MACHINE FOR FILLING AND CAPPING CARTRIDGES FOR ELECTRONIC CIGARETTES

(71) Applicant: G.D S.p.A., Bologna (IT)

(72) Inventors: Luca Testoni, Bologna (IT); Giovanni Madera, Bologna (IT); Daniele Grosso, Bologna (IT); Luca Lanzarini, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 17/899,744

(22) Filed: Aug. 31, 2022

(65) Prior Publication Data

US 2023/0063630 A1 Mar. 2, 2023

(30) Foreign Application Priority Data

Sep. 1, 2021 (IT) ..... 102021000022640

(51) Int. Cl.

| | |
|---|---|
| ***B23Q 7/04*** | (2006.01) |
| ***A24F 40/70*** | (2020.01) |
| ***B65B 1/32*** | (2006.01) |
| ***B65B 1/46*** | (2006.01) |
| ***B65B 3/04*** | (2006.01) |

(Continued)

(52) U.S. Cl.

CPC ..... *B65B 43/54* (2013.01); *A24F 40/70* (2020.01); *B65B 3/04* (2013.01); *B65B 3/28* (2013.01);

(Continued)

(58) Field of Classification Search

CPC .... B65B 1/32; B65B 1/46; B65B 3/28; B65G 47/907; B65G 47/918; B23Q 7/048

(Continued)

(56) References Cited

U.S. PATENT DOCUMENTS 3,951,272 A * 4/1976 Sankovich ..... B65G 47/847 414/744.8
4,069,646 A * 1/1978 Slomp ..... B65B 7/06 53/138.5

(Continued)

FOREIGN PATENT DOCUMENTS

EP 3822178 A1 5/2021
EP 3865410 A1 8/2021

(Continued)

OTHER PUBLICATIONS

Search Report dated May 13, 2022. 8 pages.
European Search Report dated Nov. 29, 2022. 8 pages.

*Primary Examiner* — Shelley M Self
*Assistant Examiner* — Patrick B Fry
(74) *Attorney, Agent, or Firm* — RMCK Law Group PLC

(57) ABSTRACT

An operating station for a machine for filling and capping cartridges for electronic cigarettes is arranged along a feeding path of a conveying fine of the machine and includes: an operating device having operative positions for operating on the cartridges arranged in series along a direction parallel to the feeding path; and a device for transferring cartridges, which includes a first and second series of pick-up members, each having a number of pick-up members corresponding to the number of operative positions, and which is actuatable according to a movement of rotation about a vertical axis, for selectively interchanging positions of the series of pick-up members, between a loading/unloading position at the conveying line, wherein the pick-up members pick up or release the cartridges and a working position at the operative positions of the operating device, wherein the pick-up members pick up or release the cartridges from/into the operative positions.

11 Claims, 3 Drawing Sheets

(51) Int. Cl.

| | |
|---|---|
| ***B65B 3/28*** | (2006.01) |
| ***B65B 7/28*** | (2006.01) |
| ***B65B 43/54*** | (2006.01) |
| ***B65B 57/00*** | (2006.01) |
| ***B65B 65/00*** | (2006.01) |
| ***B65G 47/90*** | (2006.01) |
| ***B65G 47/91*** | (2006.01) |
| *A24F 40/10* | (2020.01) |
| *A24F 40/42* | (2020.01) |

(52) U.S. Cl.
CPC ..... *B65B 7/28* (2013.01); *B65B 57/00* (2013.01); *B65B 65/003* (2013.01); *A24F 40/10* (2020.01); *A24F 40/42* (2020.01)

(58) Field of Classification Search
USPC ..... 53/467, 471, 502, 284.5
See application file for complete search history.

(56) References Cited

U.S. PATENT DOCUMENTS

| | | | | |
|---|---|---|---|---|
| 8,455,773 | B2 * | 6/2013 | Trebbi | G01G 17/00 141/83 |
| 9,051,650 | B2 * | 6/2015 | Gresik | C23C 14/205 |
| 9,809,878 | B2 * | 11/2017 | Black | C23C 14/185 |
| 2021/0161216 | A1 * | 6/2021 | Slurink | B65B 1/46 |
| 2021/0378317 | A1 * | 12/2021 | Testoni | A24F 40/42 |
| 2022/0068457 | A1 * | 3/2022 | Marsh | A61M 5/31 |
| 2022/0212818 | A1 * | 7/2022 | Schwandt | B65B 3/003 |

FOREIGN PATENT DOCUMENTS

| | | | | |
|---|---|---|---|---|
| WO | WO-2007003407 | A1 * | 1/2007 | B65B 1/46 |
| WO | 2019003127 | A2 | 1/2019 | |
| WO | WO-2020070573 | A1 * | 4/2020 | A24F 40/10 |

* cited by examiner

OPERATING STATION FOR A MACHINE FOR FILLING AND CAPPING CARTRIDGES FOR ELECTRONIC CIGARETTES

CROSS-REFERENCE TO RELATED APPLICATION

This application claims priority to Italian Patent Application No. 102021000022640 filed Sep. 1, 2021. The disclosure of the above application is incorporated herein by reference in its entirety.

The present invention relates to an operating station for a machine for filling and capping cartridges for electronic cigarettes.

In particular, the present invention relates to an application wherein the aforesaid machine comprises:

- a line for transporting cartridges for feeding the cartridges one after another along a feeding path;
- a station for dispensing a liquid, for dispensing a predetermined quantity of liquid into the empty cartridges;
- a station for applying at least one cap on each cartridge filled with liquid, for closing the cartridge so as to impede the liquid from flowing out.

In this context, the present invention aims to provide an operating station designed to perform at least one operation on the cartridges handled by the machine, which is capable of operating on the cartridges without slowing down the operation of the machine, and has a simple and simple configuration that is easily adaptable to existing machine solutions.

This object is achieved by means of an operating station according to claim 1.

The present invention also relates to a machine and to a method for filling and capping cartridges for electronic cigarettes.

The claims form an integral part of the disclosure provided here.

Further characteristics and advantages of the invention will become evident from the description that follows with reference to the attached drawings, provided purely by way of non-limiting example, wherein:

FIG. 1 schematically represents an example of the cartridge filling and capping machine described here;

In the following description various specific details are illustrated aimed at a thorough understanding of the embodiments. The embodiments may be implemented without one or more of the specific details, or with other methods, components, materials, etc. In other cases, known structures, materials or operations are not shown or described in detail to avoid obscuring various aspects of the embodiments.

The references used here are only for convenience and do not, therefore, define the field of protection or the scope of the embodiments.

Figure 3:
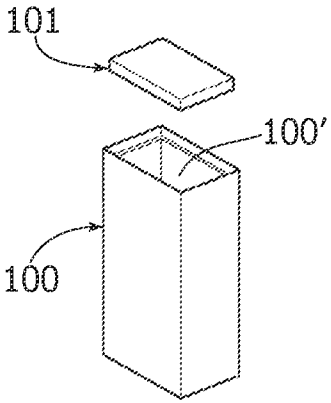
FIG. 3 represents an example of a cartridge for electronic cigarettes.

FIG. 3 illustrates an example of a disposable cartridge for electronic cigarettes. The illustrated cartridge 100 comprises a main body arranged with an inner chamber to contain a flavored liquid, which is intended for evaporation when using the cartridge with the electronic cigarette. The main body of the cartridge 100 comprises an opening 100', by means of which the inner chamber is filled with the flavored liquid during the cartridge manufacturing process, and which is then closed by a cap 101, to prevent the liquid from escaping and to preserve its properties until the cartridge is used.

Figure 1:
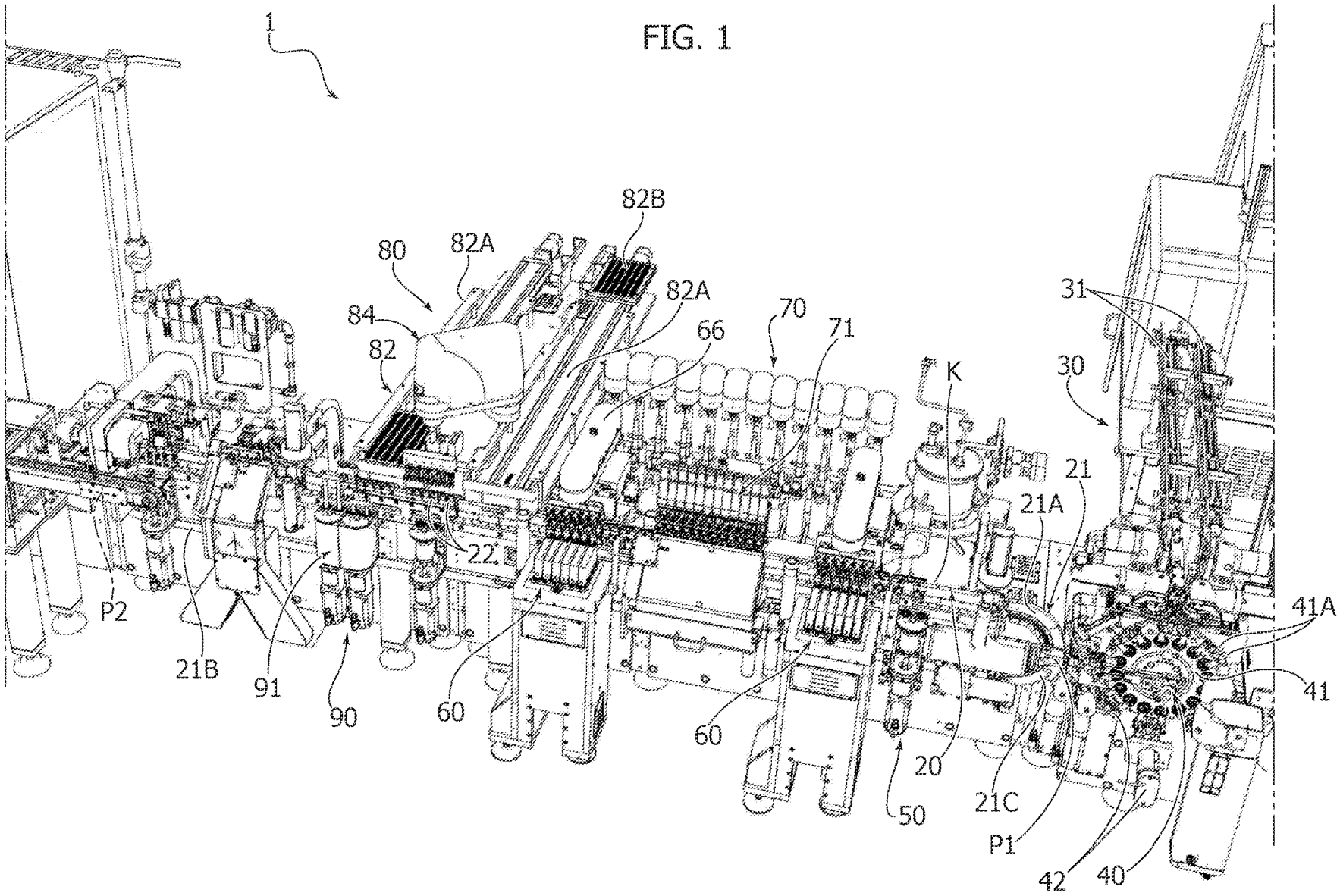

FIG. 1 illustrates an example of the cartridge filling and capping machine described here.

The illustrated machine, indicated as a whole with the reference number 1, comprises a conveying line 20 for transporting the cartridges 100 along a feeding path K. In one or more preferred embodiments, such as the one illustrated, the conveying line 20 comprises a guide 21 extending along a closed-loop path, and a series of members 22, which are movable on the guide 21. The members 22 are each equipped with one or more seats for housing the cartridges 100.

In one or more preferred embodiments, such as the one illustrated, the guide 21 has an upper portion 21A defining the feeding path K, along which the members 22 carrying the cartridges 100 advance, and a lower portion 21B, which constitutes a path for the return of the empty 22 members.

At an upstream end of the conveying line 2, the machine 1 comprises a unit 30 for supplying cartridges 100.

The unit 30 may, for example, comprise one or more channels 31 for transporting the cartridges 100 by means of air blown into these channels.

In one or more preferred embodiments, such as the one illustrated, the machine 1 also comprises a unit 40 for preparing and/or checking the cartridges 100 before they are delivered to the conveying line 20.

In one or more preferred embodiments, the unit 40 is arranged to perform the following functions:

- checking the presence of the cartridges;
- marking the cartridges;
- checking the marking performed on the cartridges;
- checking the presence of a component of the cartridges, for example a gasket rubber.

In one or more preferred embodiments, such as the one illustrated, the unit 40 comprises a wheel, 41 which is rotatable around a horizontal axis of rotation and which is arranged, at its peripheral region, with a plurality of seats 41A, distributed around the rotation axis, for receiving the cartridges 100.

A series of devices 42 are arranged around the wheel 41, to perform one or more of the aforesaid functions on the cartridges 100 carried by the wheel 41. The movement of the wheel 41 is step-wise and envisages stop positions wherein its seats 41A are found at the devices 42.

The stepwise movement of the wheel 41 also envisages a position P1 for releasing the cartridges 100 to the conveying line 20.

In one or more preferred embodiments, such as the one illustrated, this release position is found directly facing a portion 21C of the guide 21, which connects together the lower return branch 21B to the upper branch 21A defining the feeding path. K.

The empty members 22 move to the release position and pick up the cartridges 100 from the wheel 41.

In one or more preferred embodiments, such as the one illustrated, the machine 1 also comprises a station 50 for checking a component of the cartridges 100, for example, an electrical resistance. The control station 50 may, for example, comprise a device 51 for connecting the electric resistance carried by the single cartridge, to an electric power source, and a sensor for measuring the electric current, thus generated, which circulates through the same electrical resistance.

In one or more preferred embodiments, the connecting device may comprise a movable terminal member for bringing electrical contacts of the device against the electrical contacts of the cartridge, connected to the electrical resistance to be tested.

Figure 2:
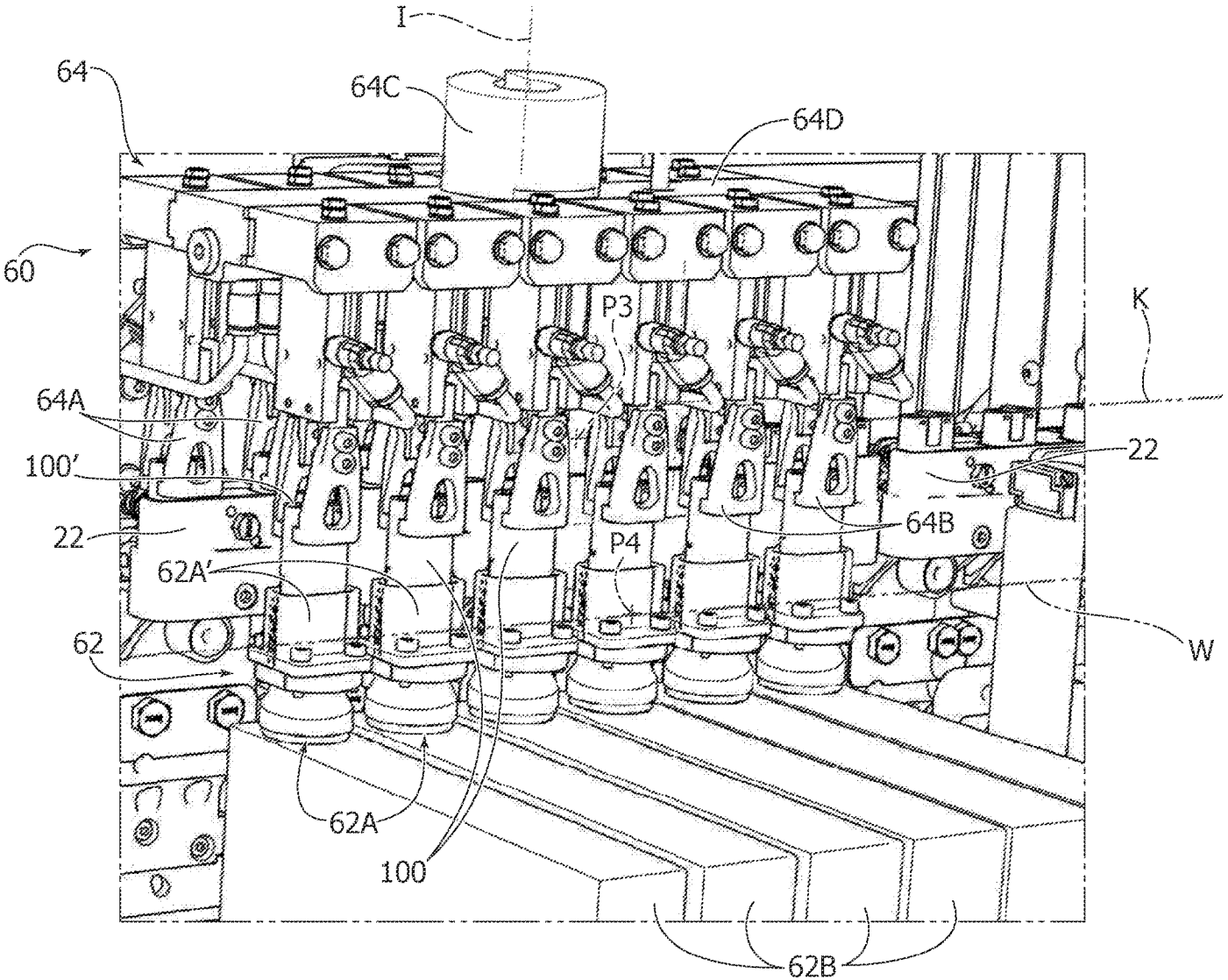
FIG. 2 illustrates a preferred embodiment of the operating station described here, according to an axonometric view.

According to an important characteristic of the solution described here, the machine 1 also comprises an operating station 60 arranged to perform a given operation on the cartridges 100, which comprises (FIG. 2):

an operating device 62 comprising a plurality of operative positions 62A for operating on the cartridges 100, which are arranged in series along a direction W parallel to the feeding path K; and a device 64 for transferring the cartridges 100, which comprises a first and a second series of pick-up members 64A, 64B, and which can be operated, preferably by means of an actuator, according to a rotation movement around a vertical rotation axis I, to selectively exchange position of the first and the second series of pick-up members between a loading/unloading position P3 at the conveying line 20, and a working position P4 at the operating stations 62A of the operating device 62.

Each series has a number of pick-up members 64A, 64B corresponding to the number of operating stations 62A of the operating device 62.

In the loading/unloading position at the conveying line 20, the pick-up members 64A or 64B of each series perform the pick-up or release of the cartridges 100 from/on corresponding mobile members 22. On the other hand, in the working position at the operating stations 62A of the operating device 62, the pick-up members of each series perform the pick-up or release of the cartridges 100 from/to the operating stations 62A or keep the cartridges 100 in position within these operating stations.

Preferably, but not exclusively, the pick-up members 64A, 64B of each series are also moved vertically from top to bottom and vice versa to perform the pick-up or release of the cartridges 100. This applies both if the cartridges 100 must be picked up/released from/to the mobile members 22, and if the cartridges 100 must be picked up/released from/to different operating stations, which will be better described below (for example, the stations 62A described below).

In the operating stations 62A, the cartridges 100 are subjected to one or more operations.

In one or more preferred embodiments, the operating device 62 comprises a weighing unit and the relative operating stations 62A are weighing stations.

Preferably, each weighing station 62A comprises a seat 62A' arranged on a scale 62B; the seat 62A' comprises a cavity wherein a single cartridge 100 is received in a condition wherein it is kept in an upright position and turns its opening 100' upwards, provided for the introduction of a liquid into the cartridge.

During operation, while a group of cartridges 100 is weighed in the weighing stations 62A, the conveying line 20 is operated to carry a new group of cartridges 100 onto respective members 22, inside the operating station 50.

After the weighing operation is completed, the transfer device 64 is then operated to change the position of the group of cartridges 100 just weighed, which is located in the stations 62A, and the new group of cartridges 100 entered in the operating station 60, which is on the conveying line 20.

The group of cartridges 100 already weighed is released (for example, with a vertical movement from top to bottom of the picking-up members 64A, 64B) on the members 22 with which the new group of cartridges 100 has reached the operating station 60, and then continues, on these members, along the feeding path K of the conveying line 20.

In one or more preferred embodiments, such as the one illustrated, the rotation axis I of the transfer device 64 is in an intermediate position between the conveying line 20 and the weighing stations 62A of the device 62.

Preferably, the transfer device 64 is suspended on a support frame 66 that extends along a direction transverse to the feeding path K and projects above the conveying line 20.

In one or more preferred embodiments, such as the one illustrated, the transfer device 64 comprises a connecting portion 64C for mounting the device rotatably about the rotation axis I. Furthermore, the transfer device 64 comprises at least one cross-member 64D, which is centrally connected to the connecting portion 64C, and which carries the two series of pick-up members 64A, 64B on respective sides in mutually opposite positions with respect to the axis rotation I. The pick-up members 64A, 64B may, for example, be pincer members or suction gripping members. In one or more preferred embodiments, such as the one illustrated, the transfer device 64 is operated according to a stepwise rotational movement, which is such that, at each position reached, the cross-member 64D is oriented so as to be parallel to the feeding path K, and the first and second series of pick-up members 64A, 64B both extend parallel to the feeding path K, one being in the loading/unloading position P3 and the other in the working position P4, or vice versa.

It should now be noted that the operating station 60 described above may—in any case—be arranged to perform any operation on the cartridges 100. In this sense, the operating device may be arranged with operating means which may vary according to the needs of the specific applications.

In one or more preferred embodiments, the operating device 62 may, for example, comprise:

a detection unit for carrying out detection on the cartridges 100, and/or a test unit for carrying out a test on the cartridges 100, and/or a unit for carrying out processing on the cartridges 100.

In one embodiment, the operating device 62 further comprises a bypass path along which the operating means of the device are arranged, for example, the aforesaid weighing units, detection units, test units and processing units. In this case, the cartridges 100 follow this bypass path before being returned to the feeding path K of the conveying line 20 again.

In one or more preferred embodiments, such as the one illustrated, the machine 1 comprises a station 70 for filling the cartridges 100, after these, still empty, have been weighed at the operating station 60.

The filling station 70 may, for example, comprise a dosing head 71 with needles, which are intended to be inserted inside the cartridges 100 through their upper openings.

In one or more preferred embodiments, the machine 1 comprises an additional operating station 60', for weighing the cartridges 100 filled with liquid, in order to verify their correct filling by the unit 70. The operating station 60' may have the same structure and the same operation described above with reference to the operating station 60. In one or more preferred embodiments, such as the one illustrated, the machine 1 comprises a station 80 for capping the cartridges 100.

Preferably, the capping station 80 comprises a system 82 for feeding caps 101, and a device 84 for applying the caps 101 onto the cartridges 100 carried by the members 22 of the conveying line 20.

In one or more preferred embodiments, such as the one illustrated, the feeding system 82 comprises at least one conveyor 82A for transporting a plurality of caps 101 on the tray 82B, up to a delivery position of the caps 101, immediately adjacent to the conveying line 20. The applicator device 84 is arranged to pick up the caps 101 individually or in groups from the tray in the delivery position, and to apply them to the cartridges 100 on the members 22 that are inside the station 80.

Preferably, the feeding system 82 comprises two conveyors 82A arranged to operate alternately, in cooperation with the applicator device 84, so that when the caps of a tray on one of the two conveyors are about to run out, a new full tray comes immediately made available in the delivery position by the other conveyor.

Preferably, the applicator device 84 consists of a pick-and-place device arranged with a terminal unit for gripping the caps 101.

Preferably, the capping station 80 may also comprise a centering device—not shown—to correct the mutual position of the caps 101 and the cartridges 100 so as to align them on respective common axes, in order to ensure their correct mutual coupling.

In one or more embodiments, the machine 1 also comprises a station 90 for pressing the already applied caps 101 onto the cartridges 100, for the purpose of pushing them into a definitive position for closing the cartridges 100.

The station 90 may, for example, comprise a device 91 arranged to compress the assembly consisting of the single cartridge 100 and the respective cap 101, acting on opposite sides, in engagement, on one side, with the cartridge 100 and, on the opposite side, with the cap 101.

The compression device may, for example, comprise two opposing members, actuated linearly along the common axis of the cartridge 100 and of the cap 101.

In one or more preferred embodiments, the machine 1 also comprises a station 110 for checking the correct insertion of the cap 101 (and/or the presence/absence of the cap 101) on the cartridge 100.

Figure 4:
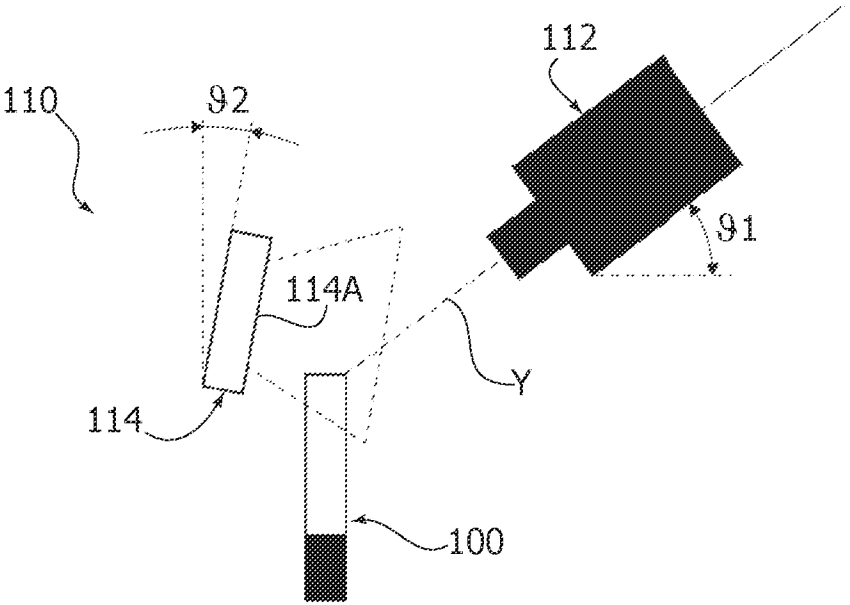
FIG. 4 illustrates a detail of a station of the machine described here.

With reference to FIG. 4, the station 110 comprises a chamber 112 placed above the conveying line 20 and facing downwards, in the direction of the cartridges 100 on the members 22, so as to orient its own optical axis Y along an inclined direction with respect to a horizontal direction, according to an angle □1 between 40° and 45°. Preferably, the optical axis Y is arranged in a vertical plane transversal to the plane wherein the conveying line 20 extends.

Furthermore, in one or more preferred embodiments, such as the one illustrated, the station 110 comprises a light source 114, which is arranged in an opposite position to the chamber 112, with respect to a cartridge 100 on a member 22 located in this station, and has a light emission surface 114A, facing downwards, in the direction of the cartridges 100 on the members 22, and, in particular, inclined with respect to a vertical direction according to an angle □2 comprised between 5° and 10°, preferably equal to 5°. Thanks to this particular arrangement of the chamber 112 and the light source 114, the station 110 is able to detect the correct insertion of the cap 101 (and/or the absence or presence of the cap 101) regardless of the color of the cap 101 and of the cartridge 100. Indeed, the tilt of the optical axis Y along an inclined direction with respect to a horizontal direction described above allows easy identification of a possible "light" between the cap 101 (which must be in contact with the edge of the cartridge 100 when correctly inserted) and the edge of the cartridge 100 itself (or rather, the upper part of the opening 100').

Furthermore, in the event that the cap 101 has not been correctly inserted to close the opening 100', in the upper part of the cartridge 100 one or more areas of shadow and/or reflections may be determined, clearly identifiable through the chamber 112. Conversely, when the cap 101 has been correctly inserted, a fully illuminated surface turns towards the chamber—defined by the cap 101 and the upper region of the cartridge 100.

Therefore, the station 110 causes the correct insertion of the cap 101 by identifying the absence or presence of the aforesaid shadow area (and/or any reflections). Clearly, the check may also be extended to the absence of the cap 101.

Downstream from the station 90 or 110, the conveying line 20 ends with a downstream end that defines a delivery position P2 for the cartridges 100, filled and closed by the caps 101, to a downstream line—not illustrated—for any additional treatments of the cartridges 100 and/or for their packaging.

Of course, without prejudice to the principle of the invention, the details of construction and the embodiments may vary, even significantly, with respect to those illustrated here, purely by way of non-limiting example, without departing from the scope of the invention as defined by the attached claims.

The invention claimed is:

1. An operating station for a machine for filling and capping cartridges for electronic cigarettes, the machine comprising:

a conveying line for transporting cartridges, wherein the cartridges are fed one after another along a longitudinally extending linear feeding path;

a dispensing station for dispensing a predetermined quantity of liquid into the cartridges;

a capping station for applying at least one cap on each cartridge filled with liquid, for closing the cartridge so as to impede the liquid from flowing out;

said operating station being arranged along the feeding path and comprising:

an operating device comprising a number of operative positions for operating on the cartridges, which are arranged in series along a longitudinal direction of the machine and parallel to the linear feeding path;

a support frame positioned above the conveying line and having a member extending along a direction perpendicular to the conveying line; and a transferring device for transferring cartridges, the transfer device being suspended on the support frame member and including:

a first and a second series of pick-up members, each series having a number of pick-up members corresponding to the number of the operative positions of the operating device;

a connecting shaft for mounting the transferring device so that the transferring device rotates about a vertical axis of rotation, and at least one cross-member, which is centrally fixed directly to the connecting shaft for common movement therewith, and which carries by direct attachment thereto the first and the second series of pick-up members, on respective first and second sides thereof in opposite positions with respect to the vertical axis of rotation such that the first series of pick-up members are directly mounted to and carried by the first side of the at least one cross member and the second series of pick-up members are directly mounted to and carried by the second side of the at least one cross member;

wherein each number of pick-up members includes a plurality of pick-up members arranged in linear succession along the longitudinal direction of the machine when in an loading/unloading position and a working position such that the first and second series of pick-up members are parallel to each other and the longitudinally extending linear feeding path when in the loading/unloading position and the working position;

wherein the first and second series of pick-up members are actuatable according to a movement of rotation about the vertical axis, for selectively interchanging positions of the first and the second series of pick-up members with each other, between:

i) the loading/unloading position at the longitudinally extending linear feeding path of the conveying line in the operating station, wherein the pick-up members pick up or release the cartridges from/into the conveying line via vertical movement, and ii) the working position at the plurality of operative positions of the operating device, wherein the pick-up members pick up or release the cartridges from/into the plurality of operative positions, which are arranged in series along the longitudinal direction of the machine and parallel to the feeding path, or keep the cartridges in position at the operative positions.

2. The station according to claim 1, wherein the vertical axis of rotation of the transferring device is in an intermediate position between the conveying line and the plurality of operative positions of the operating device;

wherein during at least one operating cycle at the operating station, one of the first and second series of pick-up members moves a group of first cartridges from the loading/unloading position to the working position and then back to the loading/unloading position, while the other of the first and second series of pick-up members correspondingly moves a group of second cartridges from the working position to the loading/unloading position and then a third group of cartridges to the working position; and wherein the first, second and third groups of cartridges are different from each other.

3. The station according to claim 1, wherein the transferring device is operated according to a rotational stepwise movement, which is such so that, at each position reached, the cross-member is oriented so as to be parallel to the feeding path, and the first and second series of pick-up members both extend parallel to the feeding path, one being in said loading/unloading position and the other being in said working position.

4. The station according to claim 1, wherein the operating device comprises a weighing unit and relative operative positions are weighing positions.

5. The station according to claim 4, wherein each weighing position comprises a seat for receiving and maintaining the cartridge in an upright position, wherein the cartridge has an opening for introducing the liquid that faces upwards, said seat being arranged on scales.

6. The station according to claim 4, wherein said operating device comprises:

a detection unit for carrying out detection on the cartridges, and/or a test unit for carrying out a test on the cartridges, and/or a unit for carrying out processing on the cartridges.

7. The station according to claim 1, wherein the pick-up members of the first and second series of pick-up members are pincer members.

8. The machine for filling and capping cartridges for electronic cigarettes, comprising:

a conveyor line for transporting cartridges, wherein the cartridges are fed one after another along a feeding path;

a dispensing station for dispensing a predetermined quantity of liquid into the cartridges;

a capping station for applying at least one capon each cartridge filled with liquid, for closing the cartridge so as to impede the liquid from flowing out; and at least one operating station according to claim 2.

9. The machine according to claim 8, wherein the operating station is a station for weighing the cartridges and is positioned upstream and/or downstream of the dispensing station, along the feeding path.

10. The machine according to claim 8, comprising a first operating weighing station, which is positioned upstream of the dispensing station, for weighing the cartridges, before they are filled, and a second operative weighing station, which is positioned downstream of the dispensing station, for weighing the cartridges filled with liquid.

11. An operating station for a machine for filling and capping cartridges for electronic cigarettes, the machine comprising:

a conveying line for transporting cartridges, wherein the cartridges are fed one after another along a feeding path;

a dispensing station for dispensing a predetermined quantity of liquid into the cartridges;

a capping station for applying at least one cap on each cartridge filled with liquid, for closing the cartridge so as to impede the liquid from flowing out;

said operating station being arranged along the feeding path such and comprising:

an operating device comprising a plurality of operative positions for operating on cartridges, which are arranged in series along a longitudinal direction of the machine parallel to the feeding path;

a support frame positioned above the conveying line and having a member extending along a direction perpendicular to the conveying line; and a transferring device for transferring the cartridges, the transfer device being suspended on the support frame member and including:

a first and a second series of pick-up members, each series having a number of pick-up members corresponding to a number of the plurality of operative positions of the operating device;

a connecting shaft for mounting the transferring device so that the transferring device rotates about a vertical axis of rotation, and at least one cross-member, which is centrally connected directly to the connecting shaft, and which directly carries the first and the second series of pick-up members, on respective first and second sides thereof in opposite positions with respect to the vertical axis of rotation such that the first series of pick-up members are directly mounted to and carried by the first side of the at least one cross member and the second series of pick-up members are directly mounted to and carried by the second side of the at least one cross member;

wherein each number of pick-up members includes a plurality of pick-up members arranged in succession such that the first and second series of pick-up members are parallel to each other and the longitudinal feeding path;

wherein the first series of pick-up members and the second series of pick-up members are actuatable according to a movement of rotation about the vertical axis, to selectively interchange a position of the first series of pick-up members at one of a loading/unloading position and a working position with a different position of the second series of pick-up members at the other of the loading/unloading position and the working position, wherein:

i) the loading/unloading position is at the feeding path of the conveying line in the operating station where the pick-up members pick up or release the cartridges from/into the conveying line via vertical movement, and ii) the working position is at the plurality of operative positions of the operating device where the pick-up members, via vertical movement, pick up or release the cartridges from/into the plurality of operative positions, which are arranged in series along the longitudinal direction of the machine parallel to the feeding path, or keep the cartridges in position at the operative positions.

* * * * *